US011350746B1

(12) United States Patent
Nobles et al.

(10) Patent No.: US 11,350,746 B1
(45) Date of Patent: Jun. 7, 2022

(54) REMOVABLE PROJECTILE RESISTANT PROTECTIVE SHIELD FOR DESKTOPS

(71) Applicants: Donald Ray Nobles, Gallatin, TN (US); Alexander Ryan Nobles, Jr., Fort Myers, FL (US)

(72) Inventors: Donald Ray Nobles, Gallatin, TN (US); Alexander Ryan Nobles, Jr., Fort Myers, FL (US)

( * ) Notice: Subject to any disclaimer, the term of this patent is extended or adjusted under 35 U.S.C. 154(b) by 63 days.

(21) Appl. No.: 16/547,483

(22) Filed: Aug. 21, 2019

Related U.S. Application Data

(60) Provisional application No. 62/721,267, filed on Aug. 22, 2018.

(51) Int. Cl.

| | |
|---|---|
| ***F41H 5/00*** | (2006.01) |
| ***A47B 96/20*** | (2006.01) |
| ***A47B 13/08*** | (2006.01) |
| ***A47B 83/00*** | (2006.01) |
| ***F41H 5/013*** | (2006.01) |
| ***F41H 5/06*** | (2006.01) |
| ***F41H 5/08*** | (2006.01) |

(52) U.S. Cl.
CPC ..... *A47B 96/20* (2013.01); *A47B 13/08* (2013.01); *A47B 83/001* (2013.01); *F41H 5/013* (2013.01); *F41H 5/06* (2013.01); *F41H 5/08* (2013.01); *A47B 2200/0084* (2013.01); *A47B 2220/0052* (2013.01)

(58) Field of Classification Search
CPC ..... F41H 5/24; F41H 5/0407; F41H 5/226; F41H 5/263; F41H 5/08; F41H 5/06; F41H 5/13; C04B 41/009; A47B 96/20; A47B 13/08; A47B 83/001; A47B 2200/0084; A47B 2220/0052
USPC ..... 89/36.01–36.7; 428/911; 109/49.5
See application file for complete search history.

(56) References Cited

U.S. PATENT DOCUMENTS

| | | | | | |
|---|---|---|---|---|---|
| 340,341 | A * | 4/1886 | Mauchain | A47C 3/26 | 248/423 |
| 541,982 | A * | 7/1895 | Nelon | A47B 39/00 | 297/174 R |
| 1,195,627 | A * | 8/1916 | Thum | A47B 39/00 | 297/172 |
| 2,168,910 | A * | 8/1939 | Merrill | A47B 39/02 | 297/172 |
| 2,579,606 | A * | 12/1951 | Oom | A47B 41/02 | 312/316 |

(Continued)

*Primary Examiner* — Michael D David
(74) *Attorney, Agent, or Firm* — Winder Intellectual Property Law LLC

(57) ABSTRACT

A bullet resistant protective shield for a desk. The protective shield comprises a shield piece having a first channel coupling mechanism. The first channel coupling includes a substantially horizontal element and a substantially vertical element. The first channel coupling mechanism corresponds to a second channel coupling mechanism on a desktop, which also has a horizontal element and a vertical element. The first horizontal element and the first vertical element define a first channel and the second horizontal element and the second vertical element define a second channel. The first vertical element can be placed in the second channel and the second vertical element can be placed in the first channel thereby removably securing the shield piece to the desktop.

20 Claims, 7 Drawing Sheets

(56) References Cited

U.S. PATENT DOCUMENTS 2,624,392 A * 1/1953 Bargen ..... A47B 39/00 312/235.9
2,673,595 A * 3/1954 Kump, Jr. ..... A47B 39/04 297/172
2,778,706 A * 1/1957 MacWhirter ..... A47B 39/02 312/316
3,622,199 A * 11/1971 Ho ..... A47B 39/02 297/172
4,238,097 A * 12/1980 Clausen ..... A47B 19/06 248/188.7
5,054,852 A * 10/1991 Tholkes ..... A61G 5/14 297/172
5,547,270 A * 8/1996 Dang ..... A47B 85/08 312/194
5,554,816 A * 9/1996 Skaggs ..... F41H 5/08 109/49.5
6,170,379 B1 * 1/2001 Taylor ..... F41H 5/08 312/196
6,622,607 B1 * 9/2003 Miller ..... F41H 5/06 2/2.5
7,146,899 B2 * 12/2006 Imblum ..... F41H 5/08 89/36.01
7,314,248 B2 * 1/2008 Mabon ..... A47B 9/08 297/172
7,934,444 B2 * 5/2011 Carberry ..... F41H 5/24 89/36.02
9,010,231 B1 * 4/2015 Cohn ..... F41H 5/08 89/36.07
9,254,037 B2 * 2/2016 Benden ..... G09F 7/18
9,615,658 B1 * 4/2017 Nobles ..... A47B 13/003
10,295,311 B1 * 5/2019 Trubacek ..... A47B 13/081
10,330,443 B2 * 6/2019 Wemhoener ..... A47C 7/62
10,591,258 B1 * 3/2020 Drummond ..... A47B 39/12
10,663,264 B1 * 5/2020 Spradlin, Sr. ..... F41H 5/02
10,866,068 B1 * 12/2020 Trubacek ..... F41H 5/18
2012/0090452 A1 * 4/2012 Sudhakar ..... B32B 15/14 89/36.02
2012/0152096 A1 * 6/2012 Peters ..... F41H 5/06 89/36.01
2014/0123882 A1 * 5/2014 Kassanoff ..... A47B 21/00 108/26
2015/0153143 A1 * 6/2015 Hollenbach ..... F41H 5/24 89/36.01
2018/0094907 A1 * 4/2018 Schley ..... F41H 5/24
2019/0063878 A1 * 2/2019 Mowbray ..... B32B 5/18
2019/0191869 A1 * 6/2019 Pensack ..... F41H 5/06
2019/0309566 A1 * 10/2019 Rush ..... A47B 97/04
2019/0353465 A1 * 11/2019 Muth ..... F41H 5/24
2020/0248990 A1 * 8/2020 Larson ..... F41H 5/06
2020/0256647 A1 * 8/2020 Howell ..... F41H 5/0407
2020/0378728 A1 * 12/2020 DeCamp ..... F41H 5/08
2021/0002946 A1 * 1/2021 Benkreira ..... E05G 5/006
2021/0018301 A1 * 1/2021 Vega ..... F41H 5/08

* cited by examiner

REMOVABLE PROJECTILE RESISTANT PROTECTIVE SHIELD FOR DESKTOPS

RELATED APPLICATION

This application claims priority to U.S. Provisional Patent Application No. 62/721,267 filed Aug. 22, 2018 which is hereby incorporated by reference for its supporting teachings.

BACKGROUND

In recent years, there have been increasingly numerous reports of shootings at schools at all levels with tragic consequences. In response to concerns over school safety, a variety of possible solutions have been proposed and implemented, from arming teachers and increasing police or security presence at schools to locking school doors during hours of operation and strengthening visitor management programs. Each of these solutions—while improving the overall safety of the school environment—cannot fully prevent hostile intrusion. Thus, an added level of protection for students and faculty against armed school intrusion would be desirable.

The present invention in its various embodiments is a removable projectile resistant shield for desktops. The protective shield is made of a projectile resistant material in whole or in part. Projectile in the present case typically means bullets but is not intended to be limited to just bullets. Rather, the term as used herein would also include any life-threatening or hazardous objects from which a student might need to be shielded such as knives, arrows, spears and explosives.

While not required, the presently disclosed projectile resistant shield can be utilized in combination with a projectile resistant desktop. For example, the protective shield disclosed herein could be used in combination with the desks discussed in U.S. Pat. No. 9,615,658 to Nobles et al., which is hereby incorporated by reference for its teachings.

When removed, the protective shield provides concealment thus making it more difficult for an armed intruder to take aim. In the event a bullet or other projectile is fired or otherwise deployed, the protective shield also serves as a shield against such projectiles. The protective shield is secured to the desktop with a removable locking channel mechanism that allows for secure seating when used as a desk but easy removal as needed.

Thus, even if an armed intruder is able to get into a school, the present invention in its various embodiments provides an added level of protection for students and faculty. The removable locking channel mechanism also allows for quick release in the event of an intruder—where seconds can mean the difference between life and death—and is simple enough that it can be operated by the youngest elementary school student.

The locking channel connection also allows for adaptability depending on the circumstances. For example, should an intruder alert be sounded, students can get under their desks and, while remaining in place, seek protection behind the protective shield as secured to the desktop. Alternatively, if mobility is needed, the shield can be removed and carried, while providing shielding protection, to a different location.

The locking channel connection allows for easy removal but, at the same time, provides a snug fit thus not interfering with the operability of the desk or creating a wobbly surface. It also accommodates a wide variety of desk styles. Key features of the invention can also be retrofitted to existing desks thus providing the additional protection while keeping implementation expenses to a minimum.

The foregoing advantages among others are provided by the present invention in its various embodiments.

SUMMARY

The present invention in its various embodiments is a bullet resistant protective shield for a desk. The protective shield comprises a shield piece having a first channel coupling mechanism. The first channel coupling includes a substantially horizontal element and a substantially vertical element. The first channel coupling mechanism corresponds to a second channel coupling mechanism on a desktop, which also has a horizontal element and a vertical element. The first horizontal element and the first vertical element define a first channel and the second horizontal element and the second vertical element define a second channel. The first vertical element can be placed in the second channel and the second vertical element can be placed in the first channel thereby removably securing the shield piece to the desktop.

The first channel can be further defined by the shield piece, a first connection element in the first channel coupling or a combination of the two. Similarly, the second channel can be further defined by the desktop, a second connection element in the second coupling mechanism or a combination of the two.

The bullet resistant protective shield can include one or more handles on the shield piece. The shield piece can be made of a variety of projectile resistant materials including but not limited to ultra-high molecular weight polyethylene, bullet-resistant glass, polycarbonates, polyurethane, fiberglass and resins alone or in combination.

In some embodiments, the coupling edges on the desktop and the shield piece can be single continuous pieces. In other embodiments, the coupling edges can be intermittent pieces. In some embodiments, the coupling edge on the desktop can be continuous and the coupling edge on the shield piece intermittent or vice versa.

DETAILED DESCRIPTION OF THE ILLUSTRATED EMBODIMENTS

Figure 1:
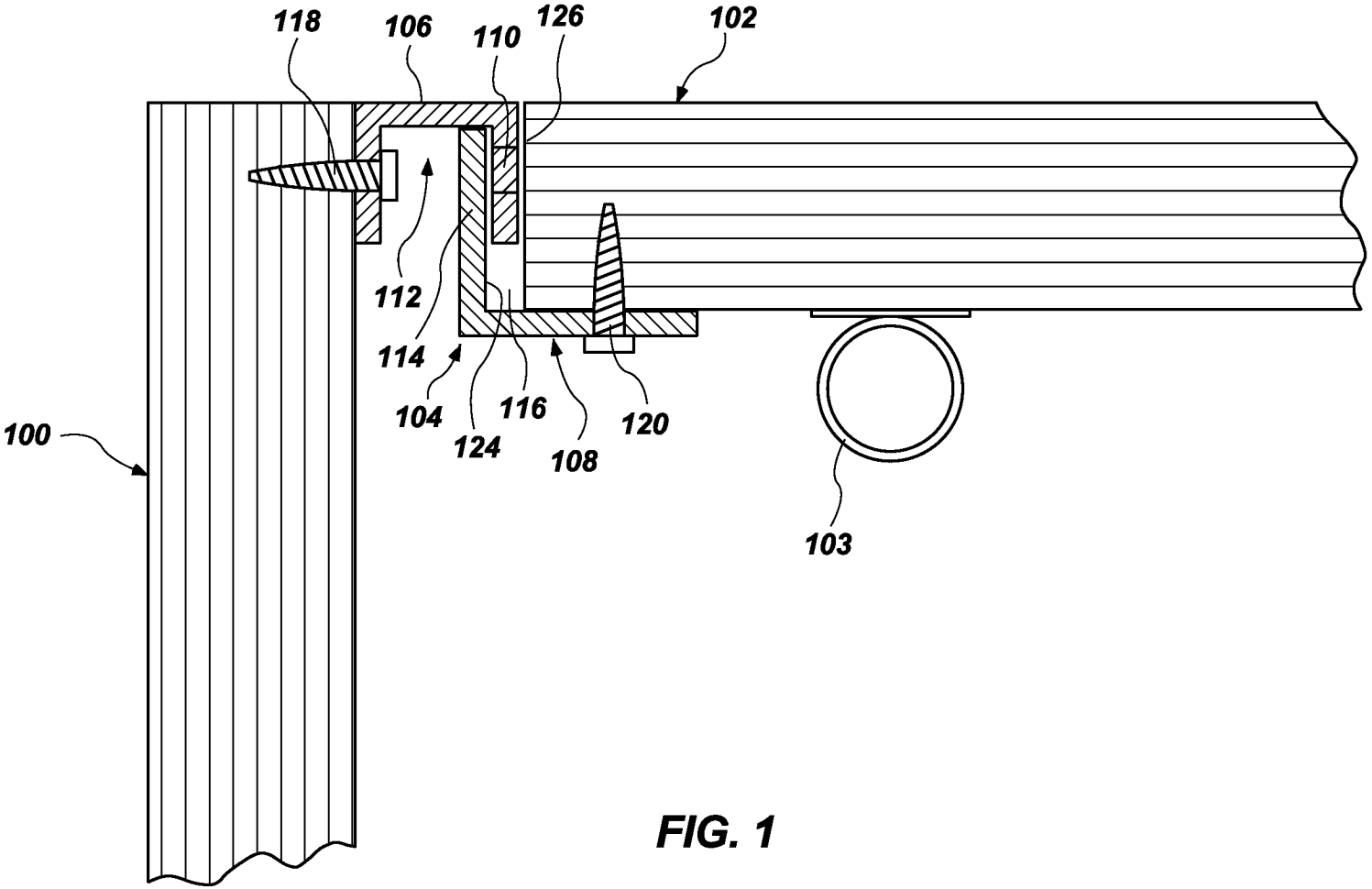
FIG. 1 shows a side view of a projectile resistant protective shield coupling mechanism according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring now to FIG. 1, a removable bullet resistant protective shield 100 is shown according to one embodiment of the present invention. The entire desk is not depicted in the figures, but FIG. 1 does depict a desktop 102 shown supported by a standard desk frame 103. It is noted that the present invention in its various embodiments is capable of being adapted for use with a variety of desk styles. It is also noted that while in a typical scholastic setting a desk would either generally be a standalone desk and chair, a multi-student desk and chairs, a frame styled desk or a storage styled desk, the term desk as used herein is not intended to be limited any particular style. Rather, the present invention could be utilized with numerous desk styles having a substantially planar work surface to which the bullet resistant protective shield can be affixed.

In the illustrated embodiments, the bullet resistant protective shield 100 is affixed to the desktop 102 with a channel coupling 104. The bullet resistant protective shield 100 is a projectile resistant material. Known projectile resistant materials suitable for use with the present invention include but are not limited to ultra-high molecular weight polyethylene, bullet-resistant glass, polycarbonates (including specialized scratch resistant polycarbonates), polyurethane, fiberglass and resins alone or in combination. Bullet resistant protective shield 100 can also be made of conventional desktop materials equipped with protective interlayers and protective films.

Figure 2:
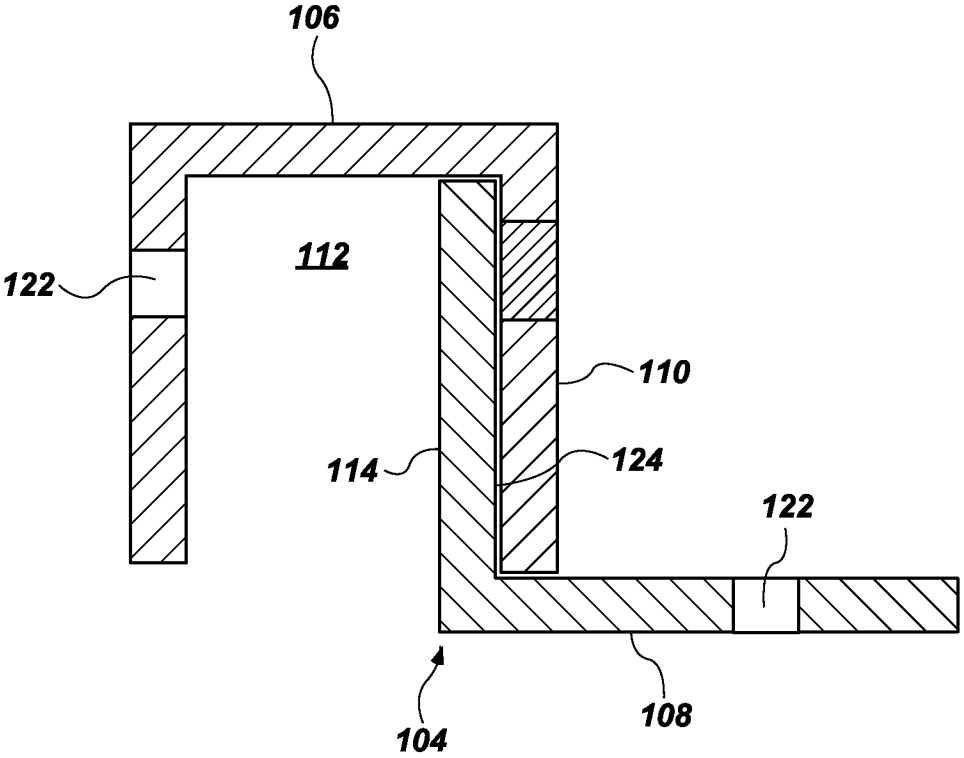
FIG. 2 shows a close-up side view of projectile resistant protective shield coupling mechanism according to one embodiment of the present invention.

The channel coupling 104 can comprise two elements: a bullet resistant protective shield coupling 106 and a desktop coupling 108. The bullet resistant protective shield coupling 106 features a coupling edge 110 and a coupling channel 112. The desktop coupling 108 also features a coupling edge 114 and a coupling channel 116. It is noted that the coupling channel 116 as depicted in FIG. 1 is formed by an inner surface 124 of the coupling edge 114 and an outer surface of the desktop edge 126. However, as discussed further below, channels 112 and 116 could be formed in other ways. Bullet resistant protective shield coupling 106 can be secured to bullet resistant protective shield 100 by a variety of fastening mechanisms 118. In the illustrated embodiment, fastening mechanism 118 is a screw through a connection element of the coupling 106 but could be various other attachment means including but not limited to nails, welds and adhesives alone or in combination. Similarly, desktop coupling 108 is secured to desktop 102 with a fastening mechanism 120. Again, in the illustrated embodiment, fastening mechanism 120 is a screw but could be various other attachment means including but not limited to nails, welds and adhesives alone or in combination. In FIG. 2, openings 122 are illustrated through which fastening mechanisms 118, 120 are inserted.

In operation, the bullet resistant protective shield 100 would be secured to the desktop by inserting coupling edge 110 into channel 116. The relative length of coupling edge 110 and depth of channel 116 could vary from embodiment to embodiment. However, in one embodiment, it is preferred that the respective length and depth are sufficient that the bullet resistant protective shield 100 when seated does not rock or wobble back and forth. When needed, the bullet resistant protective shield 100 can be lifted thereby disengaging coupling edge 110 from channel 116 allowing bullet resistant protective shield 100 to be completely removed.

Figure 5:
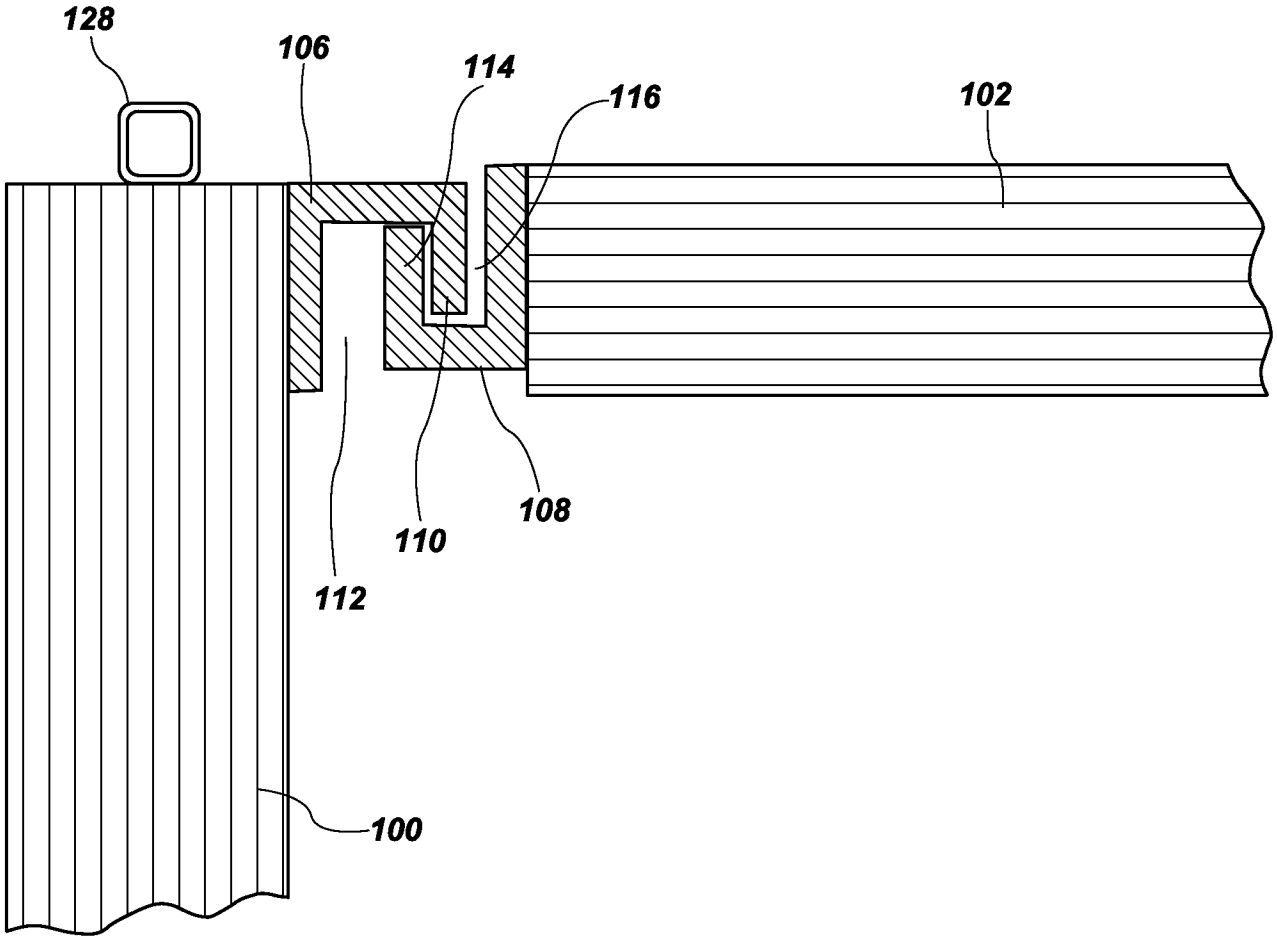
FIG. 5 shows a side view of a projectile resistant protective shield coupling mechanism according to yet another embodiment of the present invention.

In certain embodiments, bullet resistant protective shield 100 can be equipped with handles on an inside or outside surface or outer edge allowing for better user control. In FIG. 5, the top edge of the bullet resistant protective shield 100 includes grasping mechanisms 128 such as handles or knobs (FIG. 5) to aid in its removal.

Figure 3:
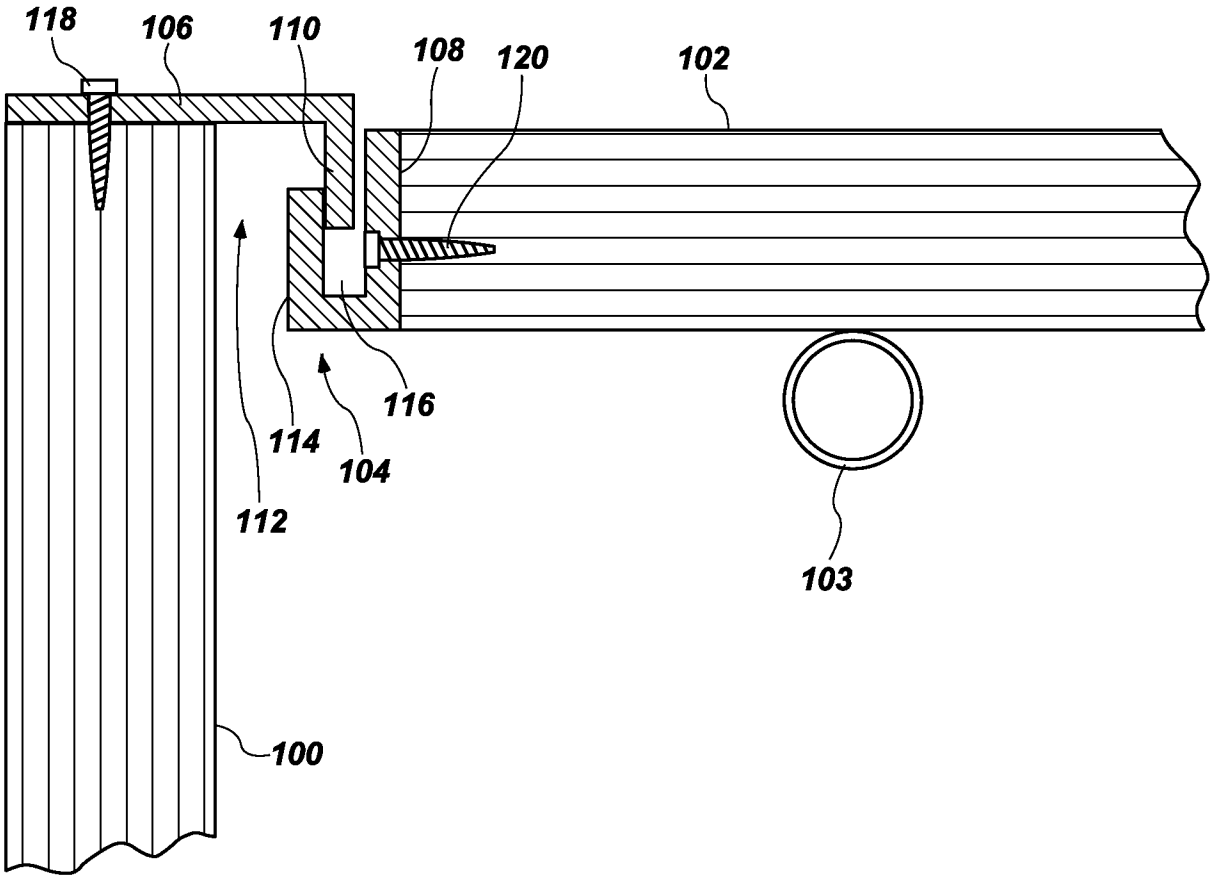
FIG. 3 shows a side view of a projectile resistant protective shield coupling mechanism according to yet another embodiment of the present invention.
Figure 4:
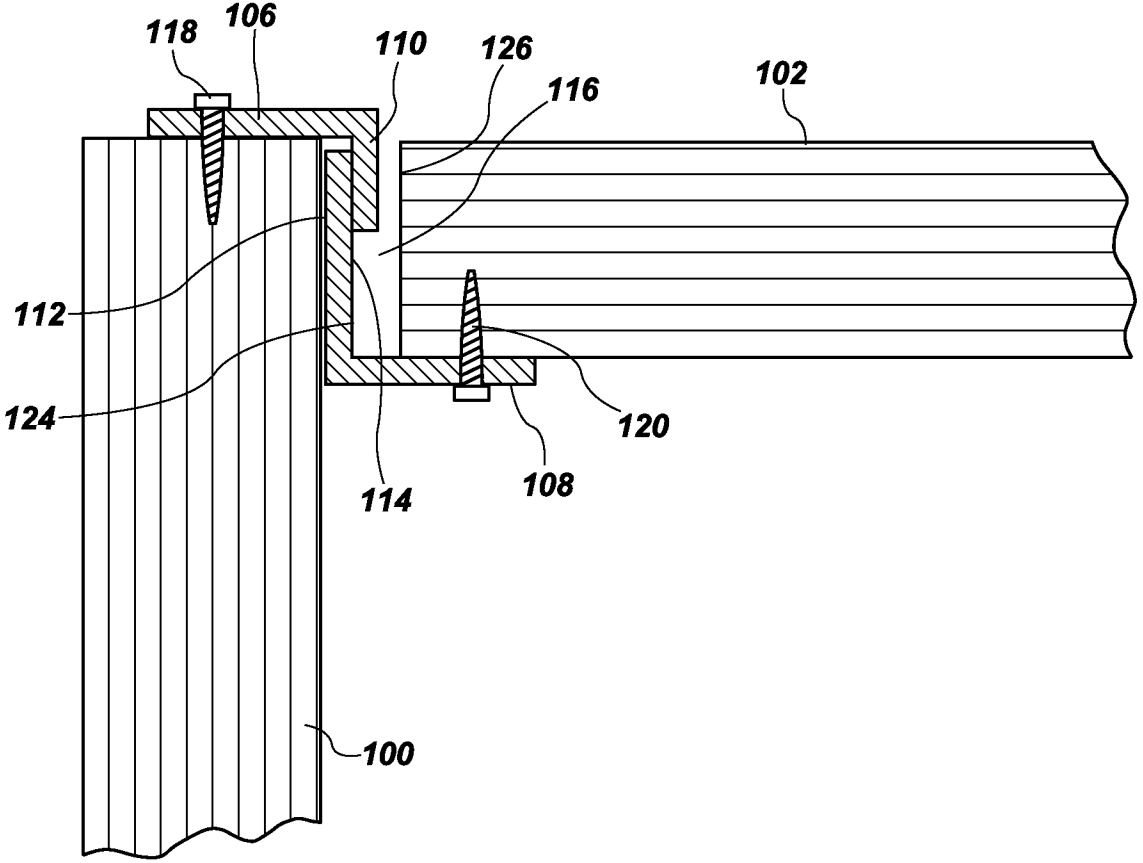
FIG. 4 shows a side view of a projectile resistant protective shield coupling mechanism according to yet another embodiment of the present invention.

Referring to FIGS. 3-5, channel coupling 104 could be accomplished in a variety of ways and yet still accomplish its intended purpose. In FIG. 3, rather than utilizing an edge of the desktop, channel 116 is formed by an integrated piece that is affixed to the edge of the desktop with a fastening mechanism 120 such as a screw through a connection element of the coupling 104. For ease of discussion, such a channel 116 will be referred to as "U-shaped." However, it is not intended to be limited to a rounded bottom but rather simply signifies that the channel 116 is formed by two substantially parallel vertical pieces flanking a bottom section. The bottom of the channel 116 could be rounded (concave or convex), V-shaped or numerous other shapes. Moreover, in the embodiments of FIGS. 1-5, the bottom of channel 116 substantially corresponds to the bottom surface of the coupling edge 110. However, in other embodiments, it is not critical that the bottom of the channel 116 match up at all with the shape of the coupling edge. Such variety in the respective shapes of channels 112, 116 and coupling edges 110, 114 can apply to all channel coupling 104 embodiments discussed herein.

Again, for ease of reference, bullet resistant protective shield coupling 106 in FIG. 3 is referred to as "L-shaped," given its cross-sectional shape. However, it is not intended to be limited to any particular angular orientation provided it has a substantially horizontal section and a substantially vertical section. In this embodiment, channel 112 is formed by coupling edge 110 and the inner surface of the bullet resistant protective shield 100. In operation, coupling edge 110 is slid into channel 116 and coupling edge 114 rests in channel 112. It is noted that channel 112 is not depicted in FIG. 3 as snugly fitting around coupling edge 114. In certain embodiments, such a fit would be acceptable. In other embodiments, a snugger fit would be preferred. Similar adaptability would apply to all channel/coupling engagements discussed herein.

Referring to FIG. 4, channel coupling 104 comprises two L-shaped couplings—one affixed to the bullet resistant protective shield 100 and one affixed to the desktop. Again, L-shaped is not intended to be limited to any particular angular orientation provided it has a substantially horizontal section and a substantially vertical section.

In FIG. 5, two U-shaped couplings are utilized. Again, U-shaped is not intended to be limited to a rounded bottom but rather simply signifies that the channel 112, 116 is formed by two substantially parallel vertical pieces flanking a bottom section. The bottom of the channel 112, 116 could be rounded (concave or convex), V-shaped or numerous other shapes.

The channel couplings 104 discussed herein could be made of numerous materials including but not limited to aluminum, steel, plastic and combinations thereof.

Figure 6:
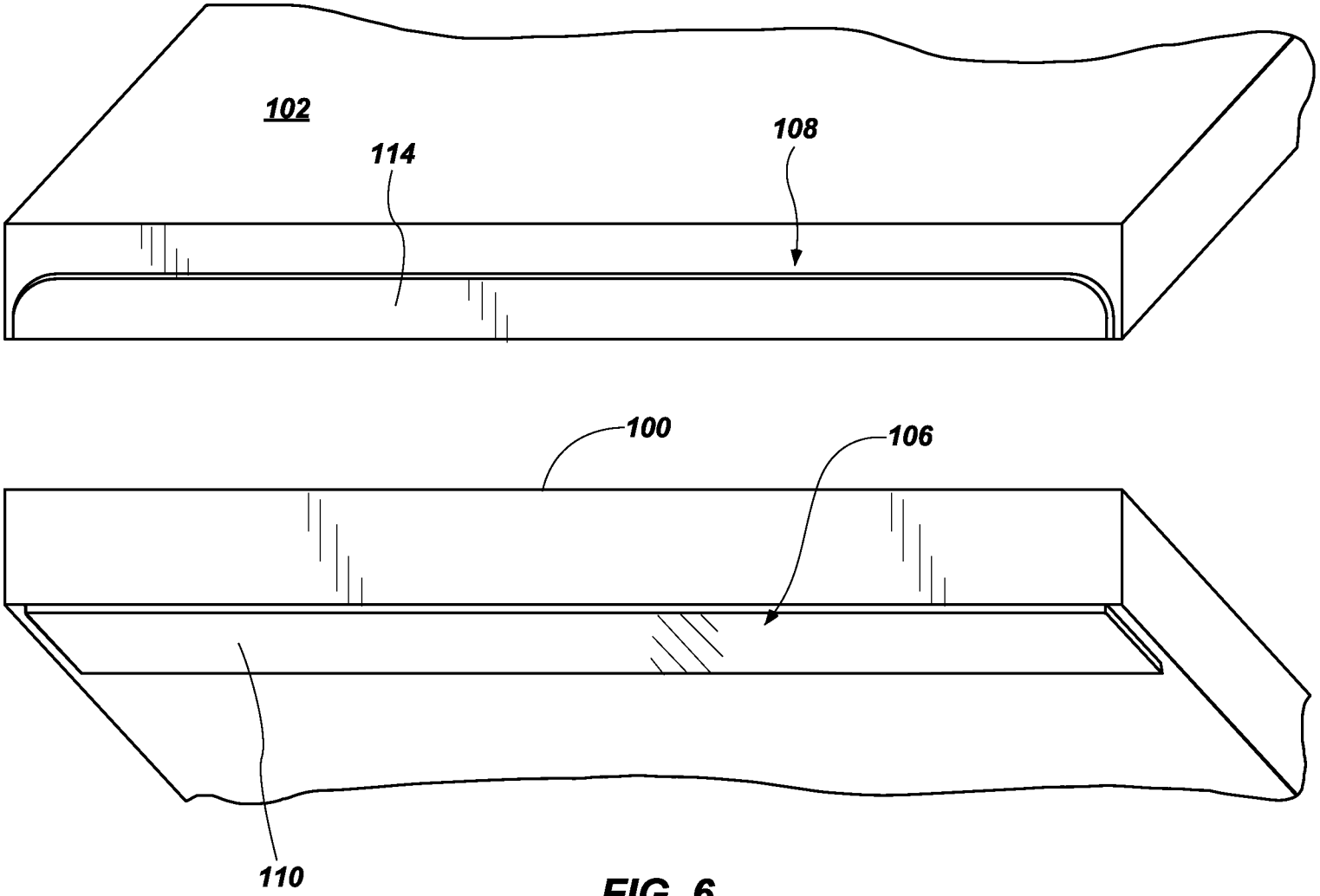
FIG. 6 shows a front perspective view of a desktop equipped with a channel coupling and a protective shield equipped with a corresponding shield coupling according to one embodiment of the present invention.
Figure 7:
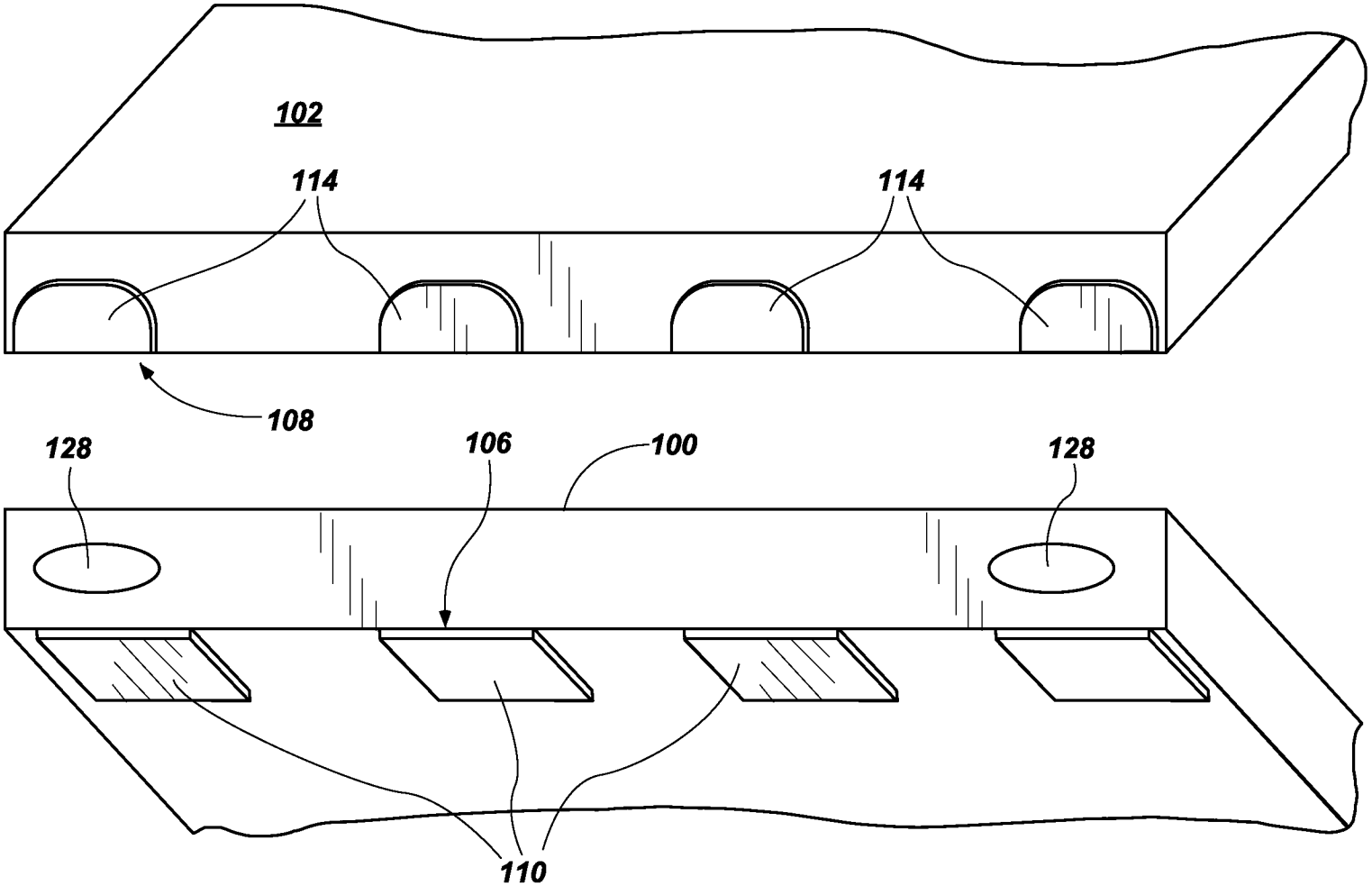
FIG. 7 shows a front perspective view of a desktop equipped with a channel coupling and a protective shield equipped with a corresponding shield coupling according to one embodiment of the present invention.

It is also noted that, as depicted in FIG. 6, coupling edges 114 along the desktop 102 and their corresponding coupling edges 110 on the protective shield 100 could be substantially continuous along the entire edge of the desktop 102 and protective shield 100. However, as seen in FIG. 7, in some embodiments, intermittent sections of coupling edges 114 on the desktop 102 and corresponding to intermittent coupling edges 110 on the protective shield 100 would suffice. It is also noted that in certain embodiments, intermittent coupling edges on the desktop could be used with a continuous coupling edge on the protective shield. Similarly, continuous coupling edges on the desktop could be used with intermittent coupling edges on the protective shield.

It is understood that the above-described arrangements are only illustrative of the application of the basic principles of the present invention. Numerous modifications and alternative arrangements may be devised by those skilled in the art without departing from the spirit and scope of the present invention. The appended claims are intended to cover such modifications and arrangements.

For example, it is noted that, as used herein, the terms vertical, substantially vertical, horizontal and substantially horizontal are intended to encompass embodiments where, for example, the coupling edge 110 is slightly angularly oriented and the receiving channel 116 is capable of receiving the coupling edge 110 at such an angle without the protective shield 100 becoming immobilized due to a poor fit. In other words, the more truly vertical the coupling edge 110 and receiving channel 116 are, the more readily one can remove the protective shield 100 when needed. Such an orientation also allows for a more substantially vertical orientation of the shield 100. Nevertheless, the invention in its various embodiments does not require strictly vertical or horizontal members in coupling the shield 100 to the desktop 102 and such variations are considered to be within the scope of the claims.

What is claimed is:

1. A bullet resistant protective shield for a desk comprising:

a) a shield piece, removable from the desk, having a first channel coupling mechanism on a first coupling edge of the shield piece, and wherein the first channel coupling mechanism further comprises a first horizontal element and a first vertical element;

b) a desktop having a second channel coupling mechanism on a second coupling edge of the desktop, and wherein the second channel coupling further comprises a second horizontal element and a second vertical element;

c) wherein the first horizontal element and the first vertical element define a first channel and wherein the second horizontal element and the second vertical element define a second channel; and d) wherein the first vertical element can be placed in the second channel and the second vertical element can be placed in the first channel removably securing the shield piece to the desktop in a substantially vertical orientation.

2. The bullet resistant protective shield of claim 1, wherein the first channel is further defined by the shield piece.

3. The bullet resistant protective shield of claim 1, wherein the first channel is further defined by a first connection element of the first channel coupling mechanism.

4. The bullet resistant protective shield of claim 1, wherein the first channel is further defined by both the shield piece and the first connection element.

5. The bullet resistant protective shield of claim 1, wherein the second channel is further defined by the desktop.

6. The bullet resistant protective shield of claim 1, wherein the second channel is further defined by a second connection element of the second channel coupling mechanism.

7. The bullet resistant protective shield of claim 1, wherein the second channel is further defined by both the desktop and the second connection element.

8. The bullet resistant protective shield of claim 1 further comprising one or more handles on the shield piece.

9. The bullet resistant protective shield of claim 1, wherein the shield piece is made of one or more materials selected from the group consisting of ultra-high molecular weight polyethylene, bullet-resistant glass, polycarbonates, polyurethane, fiberglass and resins.

10. The bullet resistant protective shield of claim 1, wherein the second coupling edge is a single continuous piece along the desktop.

11. A bullet resistant protective shield for a desk comprising:

a) a shield piece, removable from the desk, having a first channel on a first coupling edge of the shield piece and wherein the first channel is defined by a first coupling mechanism comprising a first element and a second element wherein the second element is at an approximately ninety-degree angle to the first element;

b) a desktop having a second channel on a second coupling edge of the desktop, and wherein the second channel is defined by a second coupling mechanism comprising a third element and a fourth element wherein the fourth element is at an approximately ninety degree angle to the third element;

c) wherein the first element can be placed in the second channel and the third element can be placed in the first channel removably securing the shield piece to the desktop.

12. The bullet resistant protective shield of claim 11, wherein the first channel is further defined by the shield piece.

13. The bullet resistant protective shield of claim 11, wherein the first channel is further defined by a first connection element of the first coupling mechanism.

14. The bullet resistant protective shield of claim 11, wherein the first channel is further defined by both the shield piece and the first connection element.

15. The bullet resistant protective shield of claim 11, wherein the second channel is further defined by the desktop.

16. The bullet resistant protective shield of claim 11, wherein the second channel is further defined by a second connection element of the second coupling mechanism.

17. The bullet resistant protective shield of claim 11, wherein the second channel is further defined by both the desktop and the second connection element.

18. The bullet resistant protective shield of claim 11 further comprising one or more handles on the shield piece.

19. The bullet resistant protective shield of claim 11, wherein the shield piece is made of one or more materials selected from the group consisting of ultra-high molecular weight polyethylene, bullet-resistant glass, polycarbonates, polyurethane, fiberglass and resins.

20. The bullet resistant protective shield of claim 11, wherein the second coupling edge is a single continuous piece along the desktop.

* * * * *